United States Patent [19]

Stevens

[11] 4,368,550

[45] Jan. 18, 1983

[54] METHOD AND APPARATUS FOR WINTERIZING A SWIMMING POOL

[76] Inventor: Gunther A. Stevens, 47 Peachtree La., Levittown, Pa. 19054

[21] Appl. No.: 252,912

[22] Filed: Apr. 10, 1981

[51] Int. Cl.[3] ..... E04H 3/20

[52] U.S. Cl. ..... 4/507; 4/492; 4/541; 4/542; 4/DIG. 9

[58] Field of Search ..... 4/488, 490, 492, 496, 4/506, 507, DIG. 9, 661, 541-544; 137/238, 240

[56] References Cited

U.S. PATENT DOCUMENTS

| | | | |
|---|---|---|---|
| 3,157,597 | 11/1964 | Burba | 4/507 X |
| 3,378,858 | 4/1968 | Jacuzzi | 24/289 |
| 3,831,897 | 8/1974 | Stegmeier | 4/490 X |
| 3,969,777 | 7/1976 | Beller | 4/507 |
| 4,092,746 | 6/1978 | Harris | 4/507 |
| 4,154,679 | 5/1979 | Farage | 4/507 |
| 4,246,296 | 1/1981 | Morrello | 137/240 |
| 4,281,422 | 8/1981 | Simonelli | 4/507 |

*Primary Examiner*—Stephen Marcus
*Assistant Examiner*—Kenneth S. Putnam
*Attorney, Agent, or Firm*—Richard C. Woodbridge

[57] ABSTRACT

A method and apparatus is described which makes it relatively easy for a swimming pool owner to economically and efficiently winterize a swimming pool. A one-way valve is initially connected between the swimming pool and the recirculating water return line. The valve allows water to flow out of the return line but not in the opposite direction. A sealing plate is then placed over the intake throat of to the skimmer. It is then possible to purge the return line by blowing it out from the pump end. The skimmer intake line can similarly be purged by blowing it out from the skimmer end.

9 Claims, 11 Drawing Figures

METHOD AND APPARATUS FOR WINTERIZING A SWIMMING POOL

BACKGROUND OF THE INVENTION

1. Field of the Invention

This invention relates to a method and apparatus for winterizing a swimming pool.

2. Description of the Prior Art

Swimming pools consist of many various types including in-ground and above ground. In areas of the country where freezing conditions occur, swimming pool owners must take certain steps to prevent the plumbing lines and recirculating system from freezing, so that these conduits do not crack or burst.

In the past, the most popular method of winterizing a pool was to treat the water with winterizing chemicals, lower the level of the swimming pool water below all intake and return lines, drain all conduits, and then seal off all openings. The problems inherent with this prior art method are two-fold. Firstly, by lowering the level of the pool water below all intake and return lines it is necessary to lose thousands of gallons of water. This is a wasteful and expensive practice. Secondly, a considerable amount of time and effort was required to perform the job. It should also be noted that many in-ground pools depend upon the pressure of the water on the sidewalls to keep the sidewalls from caving in. Lowering the water level below the intake and return lines increases the danger that the sidewalls may collapse.

U.S. Pat. No. 4,092,746 entitled "Swimming Pool Apparatus" and issued to R. Harris on June 6, 1978 is relevant in that it appears to be directed towards a method for winterizing a swimming pool without having to lower the water level below the drain line. Four different embodiments are disclosed. The first embodiment is illustrated in FIGS. 1–4 of that patent and described at Column 3, lines 7–39. Basically, the apparatus involves a box-like structure which is positioned to surround an outlet to form a water-tight seal thereby preventing water from flowing from the main portion of the swimming pool into the interior chamber of the box. Water can then be pumped from the box, draining the various lines. A beehive grill may be removed and replaced by a blind flange. The device described in U.S. Pat. No. 4,092,746 has the drawbacks that it takes a considerable amount of time to install and the multiple step procedure is difficult to follow.

U.S. Pat. No. 4,154,679 entitled "Operating Mechanism for Swimming Pool Skimmer" issued to F. Farage on May 15, 1979 is directed towards an improved skimmer. It otherwise does not appear to be relevant to the process of winterizing a swimming pool.

U.S. Pat. No. 3,378,858 entitled "Drain Assembly" issued to C. Jacuzzi on Apr. 23, 1968 describes an anti-vortexing drain assembly. It appears relevant only insofar as it relates to the draining of a swimming pool.

U.S. Pat. No. 3,157,597 entitled "Controlled-Flow-Inlet Swimming Pool System" issued to B. T. Burba on Nov. 17, 1964 describes an arrangement whereby inlet water is introduced into the pool at the bottom.

U.S. Pat. No. 3,831,897 entitled "Skimmer Throat Entrance Form" issued to W. J. Stegmeier on Aug. 27, 1974 describes a form used in the construction of swimming pools. That disclosure is relevant insofar as it shows other types of swimming pool construction.

Finally, U.S. Pat. No. 3,969,777 entitled "Overflow-Siphoning Device for Swimming Pools and the Like" issued to S. J. Beller on July 20, 1976 is directed to an arrangement for discharging excess water through a siphoning device. It is of interest only insofar as it discloses a device which might be used in the prior art to drain overflow from a swimming pool in order to maintain a normal water level in the system.

SUMMARY OF THE INVENTION

Briefly described the invention relates to an efficient method and apparatus for winterizing a swimming pool. The method includes the following steps, not necessarily in the following order. One way valves are placed in the return lines of the recirculating water system at the end of the lines closest to the swimming pool. The one-way valves allow water to pass out of the return line into the swimming pool but not vice versa. One-way ball valves or diaphragm valves should be used but it is possible that other types of valves may be suitable. The skimmer intake throat is sealed by means of a plate which absolutely prevents water from entering or exiting the skimmer unit.

In order to purge the system, a source of low pressure air, such as the exhaust of an industrial vacuum cleaner, is introduced into the skimmer in such a fashion as to blow the water out of the intake line through the hair and lint collector on the pump of the recirculating water system. The positive low pressure exhaust of such a vacuum cleaner is in the neighborhood of 6.5 lbs./sq. in. A plug of a one-way valve is then placed in the intake line at the bottom of the skimmer pump to prevent water from collecting in the intake line. In a similar manner the return line is purged by blowing water out of it from the pump end through the one-way valve connected at the other end of the return line. Once water has been removed from the return lines it is impossible for them to fill up with water again due to the presence of the one-way valves.

These and other features of the invention will be more fully appreciated by referring to the following drawings and detailed description of the invention.

DETAILED DESCRIPTION OF THE INVENTION

During the course of this description like numbers will be used to identify like elements according to the different views which illustrate the invention.

Figure 1:
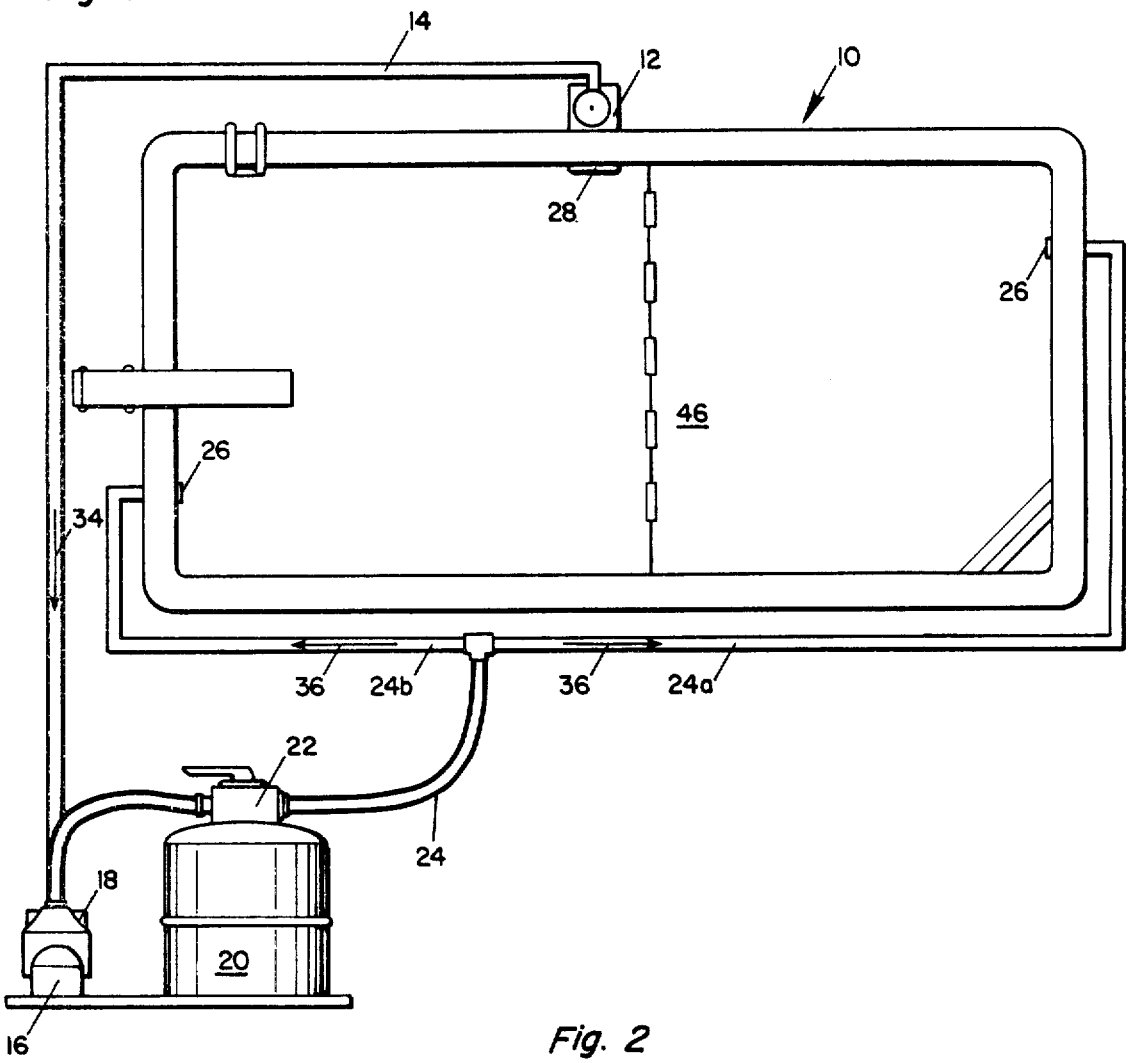
FIG. 1 is a top plan view of a swimming pool which incorporates the preferred embodiment of the invention.

The invention 10 as shown in FIG. 1 is found in the context of a swimming pool 46 having a conventional recirculating water system. A standard skimmer unit 12 is attached by intake line 14 to a pump 16. Pump 16 includes a hair and lint pot 18 which can be drained by one or more plugs on the underside thereof. Pump 16 is connected to a conventional filter assembly 20 having standard filter plumbing 22 on the top thereof. The filter plumbing unit 22 is attached to return line 24 which splits at a T-fitting into return lines 24*a* and 24*b*. Return lines 24*a* and 24*b* return the cleaned water to the swimming pool 46. While two return lines 24*a* and 24*b* are illustrated it will be appreciated by those of ordinary skill in the art that one return line or three or more return lines may also be used under appropriate circumstances depending upon the size of the pool and the characteristics of the recirculating water system.

Swimming pool 46 includes sidewalls 40 covered by a liner material 48 and backed up by natural earth 42. A rim 38, known in the art as coping, covers the edge of the top of the pool. Swimming pool 46 represents in a broad sense various other types of pools such as spas and the like, and can be constructed of different materials, including, for example, steel, aluminum, fiberglass, structural foam, concrete and gunite.

Figure 2:
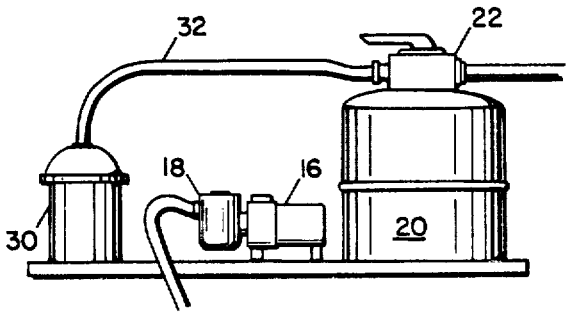
FIG. 2 is a schematic elevational view of the pump and filter units of the swimming pool water recirculation system showing the manner in which the intake line can be purged by the exhaust of a vacuum cleaner.

FIG. 2 illustrates the manner in which the exhaust line 32 of a standard cannister vacuum cleaner 30 may be connected to the pump unit 16. Details of the purging technique will be discussed later.

Figure 3:
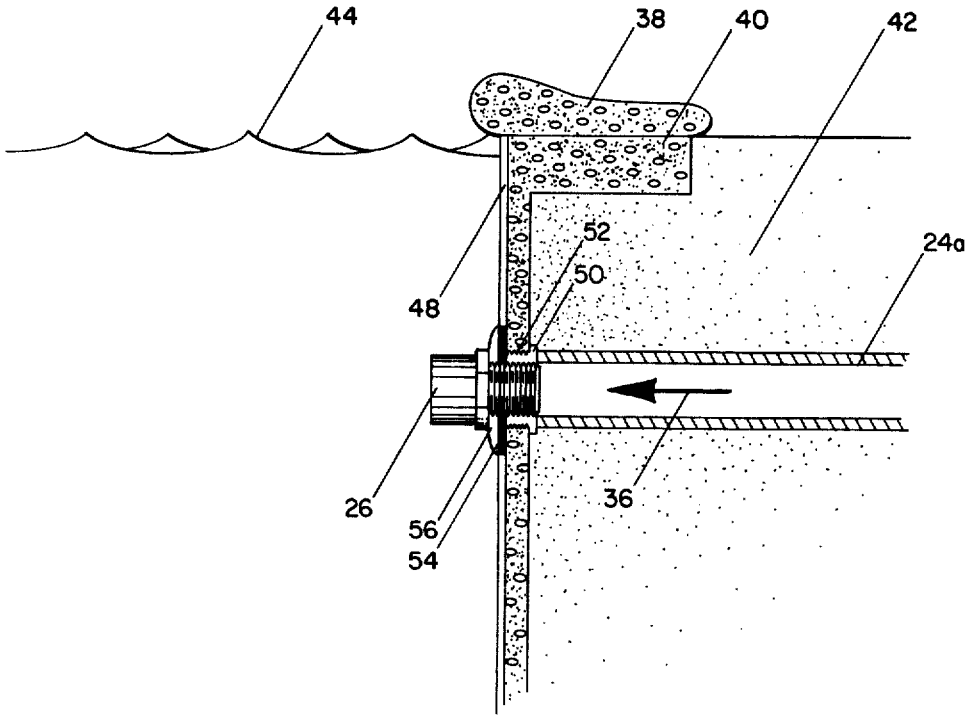
FIG. 3 is a side partial cross-sectional view of a swimming pool showing the manner in which one-way valves may be placed in the return lines.
Figure 4:
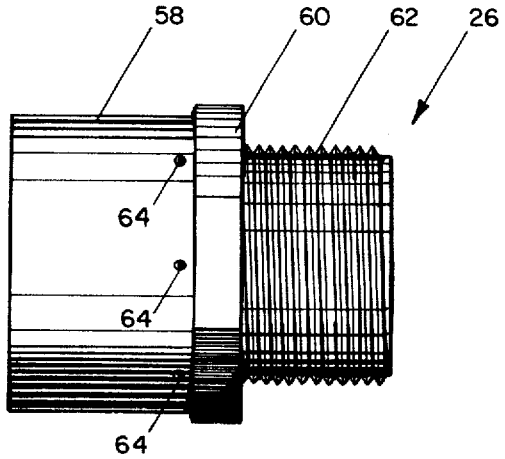
FIG. 4 is an external side view of a one-way valve.
Figure 7:
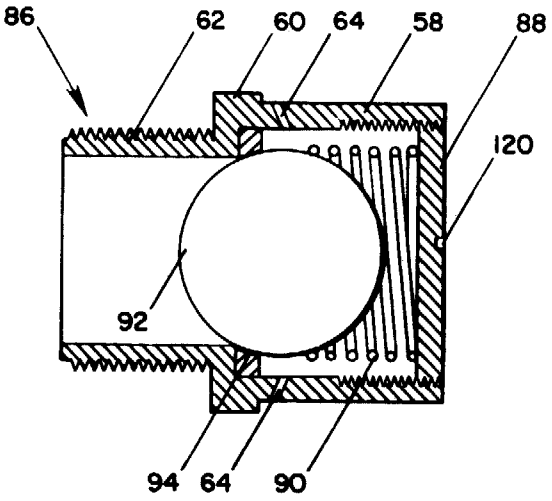
FIG. 7 is a cross-sectional view of a one-way ball valve.
Figure 8:
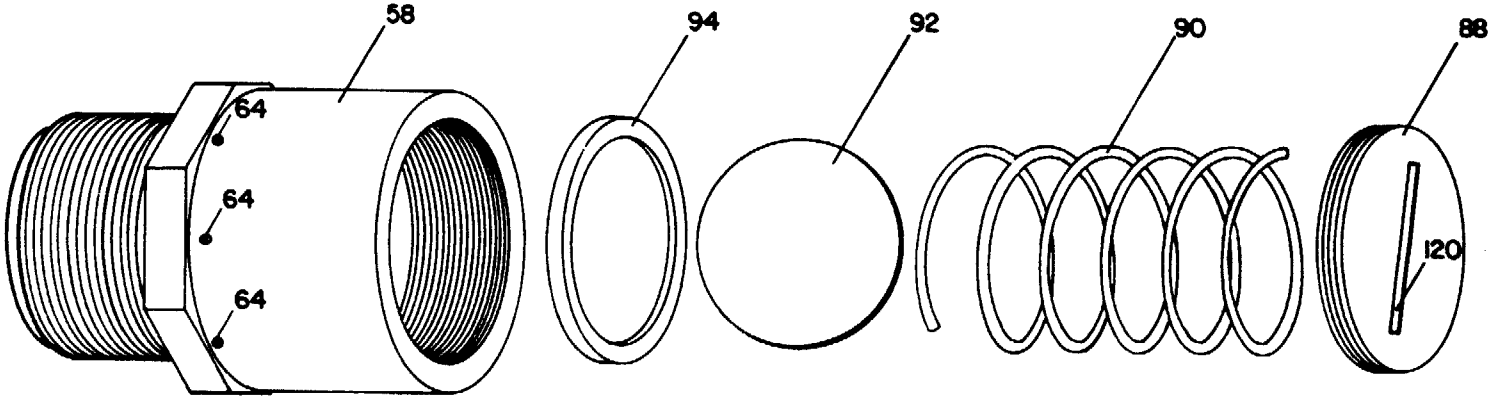
FIG. 8 is an exploded view of the elements which comprise the one-way ball valve of FIG. 7.

FIG. 3 illustrates in detail how a one-way valve 26 is connected to a return line 24*a*. One-way valve 26 preferably comprises a diaphragm valve 66 as illustrated in detail in FIGS. 5 and 6. Alternatively, the one-way valve 26 could also comprise a ball valve 86 such as illustrated in FIGS. 7 and 8. Other one-way valve embodiment may be useable also. Regardless of whether or not the one-way valve 26 comprises a diaphragm valve 66 or a ball valve 86, the housing 58 preferably remains as illustrated in FIG. 4. One-way valve housing 58 includes wrench flats 60 and a threaded shank 62. Relief holes 64 allow air or water to pass out of the one-way valve 26.

The threads 62 of one-way valve 26 are mateable with complementary threads 62 on wall fitting 56. Wall fitting 56 may comprise a standard wall fitting model No. SP 1408 such as manufactured by the Haward Manufacturing Company, Inc., 900 Fairmont Avenue, Elizabeth, New Jersey. A gasket 54 is typically located between the fitting 56 and the pool wall 40 and secured in that position by retainer nut 50.

Return line 24*a* is attached to a PVC nipple within the wall fitting 56. Swimming pool 46 is shown filled with water which has a normal upper water surface level indicated by number 44. As shown in FIG. 1 a second return line 24*b* may also be found in the context of a conventional swimming pool 46. According to the present invention another one-way valve 26 would also be installed in the other return line 24*b*. In general all return lines are installed with a one-way valve 26 which permits flow out of the return lines 24*a* or 24*b* into the swimming pool but not vice versa.

Figure 5:
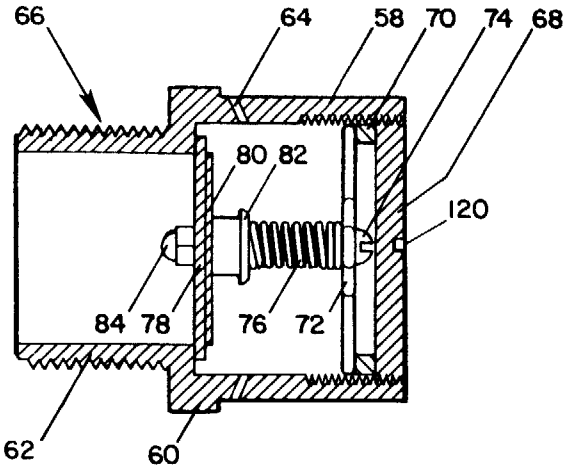
FIG. 5 is a cross-sectional view of a one-way diaphragm valve according to the preferred embodiment of the invention.
Figure 6:
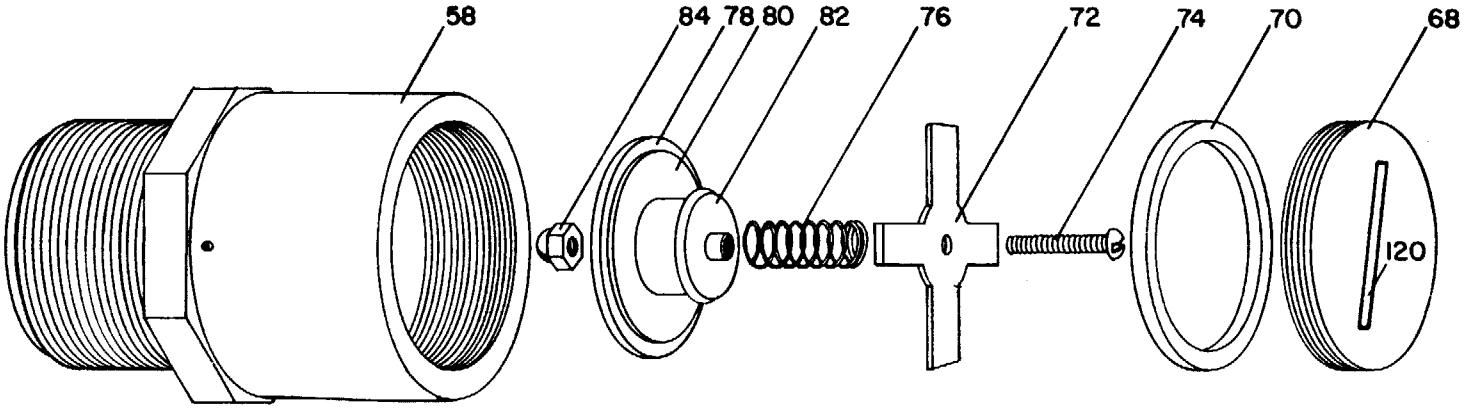
FIG. 6 is an exploded view of the elements of the diaphragm valve of FIG. 5.

The structure of the preferred embodiment 66 of the one-way valve 26 can be appreciated by referring to FIGS. 5 and 6. Housing 58 preferably comprises cycolac PVC or other appropriate plastic-like material. One end of the housing 58 is sealed by a threaded and slotted plastic cap 68. Slot 120 allows the cap 68 to be easily removed for maintenance purposes. Support ring 70 sits between cap 68 and support mounting plate 72. Stainless steel bolt 74 passes through support mounting plate 72 and is attached to diaphragm 78 by a threaded capping nut 84. Diaphragm 78 is carried by a support plate 80 and a collar 82. Bolt 74 passes through the center of stainless steel spring 76. Spring 76 biases the diaphragm 78 into the closed position against the valve seat formed by the interior rim of the housing 58. Whenever the pressure on the inside of intake line 24*a* or 24*b* exceeds the biasing force of spring 76 then water will pass out of one-way valve 66 through relief holes 64. However, pressure from the water 44 in the swimming pool passing through relief holes 64 tends to further bias the diaphragm 78 into the closed position. Therefore, water or air can only pass from the inside of one-way valve 66 out through relief holes 64 but not vice versa. The elements of the one-way diaphragm valve 66 illustrated in FIG. 5 are shown in exploded detail in FIG. 6.

The one-way diaphragm valve 66 can, alternatively, be replaced by the one-way ball valve 86 illustrated in FIGS. 7 and 8. A threaded cap 88 covers one end of housing 58 in the same manner that cap 68 covers the diaphragm one-way valve embodiment 66. One end of stainless steel spring 90 pushes against cap 88 while the other end urges ball 92 against a valve seat 94. Valve seat 94 may comprise a separate gasket or ring which sealingly engages the ball 92 which is urged into the sealing position by spring 90. The diaphragm gasket 78 of the diaphragm embodiment 66 and the sealing gasket 94 of the one-way ball valve embodiment 86 are preferably constructed of any suitable gasketing material which is resilient in nature. An example of an appropriate material would be neoprene or other similar elastomeric substance. The ball valve 86 will remain closed as long as the pressure at the threaded end of the ball valve is less than the pressure exerted by spring 90 on the ball 92. If the pressure on the inside of the ball valve 86 exceeds the exterior pressure, then the ball 92 will be urged away from sealing gasket 94 and the interior pressure will escape through relief holes 64. Diaphragm valve 66 and ball valve 86 operate in essentially the same way.

Figure 9:
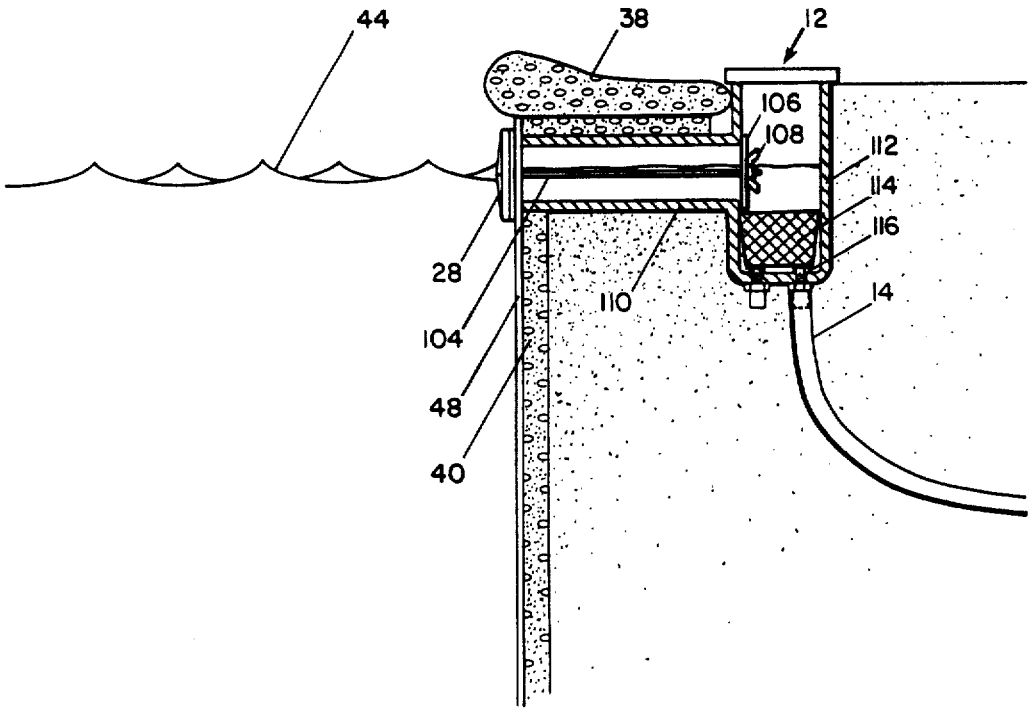
FIG. 9 is a cross-sectional elevational view of the skimmer unit showing its relationship to the sealing plate and the water intake line.
Figure 10:
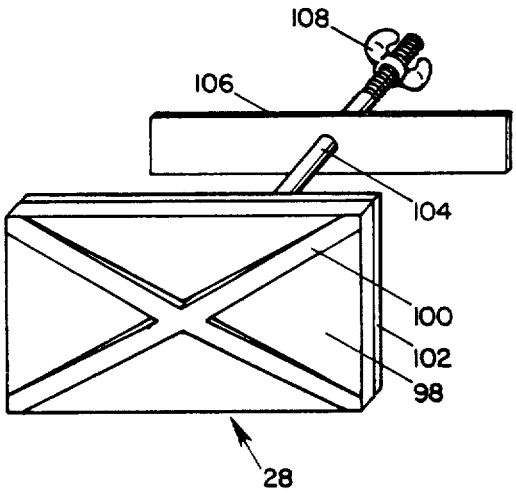
FIG. 10 is a perspective view of the skimmer sealing plate.
Figure 11:
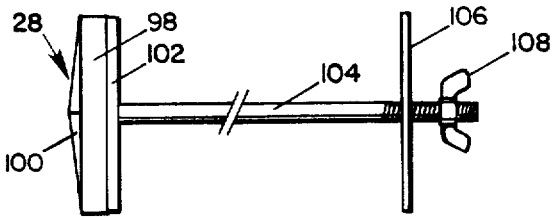
FIG. 11 is an elevational view of the skimmer sealing plate shown in FIG. 10.

Most modern swimming pools 46 which include a recirculating water system also include a skimmer unit 12 such as illustrated in FIGS. 1 and 9. Typical of such devices is the Model No. SP 1084 through-wall skimmer manufactured by Hayward Manufacturing Company, Inc., 900 Fairmont Avenue, Elizabeth, New Jersey. Water drawn in through the skimmer passes through the skimmer intake throat 110 and through intake line 14 in the direction of arrow 34 to pump 16. It is returned through the filter 20 and lines 24*a* or 24*b* in the direction of arrow 36 to the pool 46. Skimmer intake throat 110 is connected at one end to the pool 46 and at the other end to the skimmer sump 112. A filter basket 114 is located in the well of the sump 112 and serves to catch debris before the water passes into intake line 24.

According to the teachings of the present invention it is important to seal off the skimmer unit 12 with skimmer intake sealing plug 28 prior to purging intake line 24 of water. The skimmer sealing apparatus 28 essentially comprises a sealing plate 98 attached by a bolt 104 to a rear hold bracket 106. The sealing plate 98 can be made in a variety of sizes to fit the different size skimmers manufactured by other companies. A wing nut 108 is received on the threads of bolt 104 and can be used to tighten up the apparatus 28. Plate 98 is preferably rectangular in shape and formed by cycolac of the like. Ribs 100 increase the strength of the plate. A gasket 102 made of suitable sealing material is located on the side of plate 98 which covers the skimmer intake throat 110. The sealing plug 28 is connected to the skimmer 12 in the manner illustrated in FIG. 9.

Initially the rear hold bracket 106 and the wing nut 108 are removed. The threaded bolt 104 is then inserted through the skimmer intake throat 110 until the gasket 102 of the plate 98 comes into firm sealing engagement with the pool end of intake throat 110. The rear hold down bracket 106 is then slipped over the end of threaded bolt 104 that is located in the sump 112 of skimmer 12. Wing nut 108 is then placed on the bolt 104 and is tightened down in such a way as to bring the rear hold bracket 106 into tight engagement with the walls of the skimmer sump 112. This action tends to draw the plate 98 and sealing gasket 102 into tight sealing relationship with the skimmer intake throat 110 thereby completely sealing off the skimmer 12 from the water 44 in pool 46. Skimmer bracket 114 is usually removed before the skimmer sealing apparatus 28 is installed. It is also desirable to place a closure plug 116 at the location where intake line 14 comes into skimmer sump 112. Normally this plug 116, which may be either an absolute plug or a one-way valve similar to embodiment 66 or 86, is not installed until after the intake line 14 has been purged of water.

According to the present invention 10 the swimming pool 46 is winterized in the following manner. Initially the skimmer 12 is sealed by the closure plug apparatus 28 in the manner illustrated in detail in FIG. 9. In this way no further water 44 can enter into or out of the skimmer unit 12. Return lines **24*a* and 24*b* are also sealed with one-way valves 26. One-way valve 26 may comprise either the preferred embodiment 66 or the alternative embodiment 86. At the present time there are no other known embodiments for the one-way valve that will work, however, it is possible that with some effort, other workable embodiments might be identified as developed. The presence of one-way valve 26 in the return lines 24*a* and 24*b* prevents water or air from traveling through the return lines 24*a* or 24*b* in a direction other than the direction of arrow 36 as shown in FIG. 1. It doesn't make any difference whether the skimmer unit 12 is sealed first and then the return lines 24*a* and 24*b* are sealed by one-way valves 26 or vice versa. The recirculating water system is ready for winterizing once the sealing plate 28 is in the position illustrated in FIG. 9 and the one-way valves 26 are installed in return lines 26*a* and 26*b* as illustrated in FIG. 3. Under those conditions a certain amount of water 44 remains within intake line 14, return lines 24*a* and 24*b* and skimmer unit 12. This water 44** must be removed in order to prevent freezing in the recirculating water system. Freezing may cause the plumbing to crack or burst.

The purging of the lines is accomplished through the use of an industrial cannister-type vacuum cleaner 30 having a line 32 connected to its exhaust. It is also possible to use an air compressor as a source of pressurized air, but vacuum cleaners are more commonplace and therefore more readily available to the average pool owner. Initially the filter plumbing 22 is removed from filter 20. The exhaust line 32 from the industrial cannister vacuum cleaner 30 is then inserted into return line **24*a* and 24*b*. Note that lines 24*a* and 24*b* merge into a single line 24 which enters filter plumbing 22. The positive pressure from line 32 passes through line 24 and split lines 24*a* and 24*b* thereby forcing the remaining water within those lines out through one-way valves 26. The positive pressure is approximately 6.5 lbs./sq. in. Once a steady stream of air bubbles is noticed to exit through one-way valves 26 into the water 44 it can be safely assumed that the lines are purged. When the vacuum 30 is turned off, the lines 24*a* and 24*b* automatically seal themselves by virtue of the presence of one-way valves 26. Next the pressure vacuum hose 32 is inserted into the skimmer unit 12 and air pressure is introduced into line 14 thereby pushing the water 44 within line 24 back to pump 16. After all the water 44 has been forced out of line 14 and replaced by air, the water 44 is then drained out of pump 16 through the openings in the hair and lint pot 18. To insure that intake line 24 remains purged a plug or one-way valve 116 is inserted at the point where intake line 14 comes into the skimmer sump 112 in the manner illustrated in FIG. 9. The plugs in the hair and lint pot 18 then are replaced and the vacuum equipment put away. The pool 46** is now winterized.

It is relatively easy to put the pool 46 back into operation after the freezing season has passed. To accomplish this end the owner merely removes the sealing plug 28 on the skimmer 12, the skimmer plug 116 located in the skimmer sump 112 and the on-way valves 26 located at the end of return lines **24*a* and 24*b***. The system is now in condition for normal summer usage.

There are a number of changes that could be made to the present invention. The recirculating water system illustrated in FIGS. 1 and 2 is provided for illustrative purposes only. There are a number of different recirculating water systems known to those of ordinary skill in the art to which the present invention 10 can be applied. It will also be appreciated that there are a variety of different materials which could be used for the construction of the one-way valves 66 and 86 and the skimmer sealing plug apparatus 28.

While the invention has been described with reference to the preferred embodiment thereof it will be appreciated by those of ordinary skill in the art that modifications can be made to the structure and function of the parts without departing from the spirit and scope of the basic idea.

I claim:

1. In a swimming pool system including a pool and a water recirculating system including at least a skimmer means having an intake throat connected to said pool, an intake line connected to said skimmer, a pump connected to said intake line and a return line connecting said pump to said pool, the improvement comprising:

one-way valve means connected to said return line for allowing water to pass through from said return line to said pool but not in the reverse direction; and, skimmer sealing means attached to said skimmer for substantially completely blocking the flow of water into said skimmer.

2. The apparatus of claim 1 further comprising:

pressure means connectable to said system for forcing water out of said intake and return lines.

3. The apparatus of claim 1 wherein said one-way valve means comprises a ball valve.

4. The apparatus of claim 1 wherein said one-way valve means comprises a diaphragm valve.

5. The apparatus of claim 1 wherein said skimmer sealing means comprises:

a skimmer plate means for completely covering the intake throat of said skimmer and preventing water flow into and out of said skimmer;

a threaded bolt means attached to said skimmer plate means, said bolt means being substantially long enough to extend the length of said skimmer throat;

a rear hold bracket means connected to said threaded bolt for anchoring the skimmer sealing means to said skimmer; and, threaded means attached to said threaded bolt means for forcing said rear hold bracket means against the interior of said skimmer and applying sealing pressure to said skimmer plate means.

6. The apparatus of claim 5 wherein said skimmer sealing means further comprises:

gasket means attached to said skimmer plate means for improving the seal between said skimmer plate means and said skimmer throat.

7. The apparatus of claim 6 wherein said skimmer plate means further comprises:

ribs attached to said skimmer plate means for improving the strength and rigidity of said skimmer plate means.

8. A method for winterizing a swimming pool of the type having a water recirculating system including at least a skimmer connected to said pool by a skimmer throat, an intake line connected to said skimmer, a pump connected to said intake line and a return line connecting said pump to said pool, said method comprising the steps of:

placing a one-way valve means in said return line to prevent the flow of water from said pool into said return line but not vice versa;

sealing off said skimmer throat with a skimmer sealing means; and, blowing water out of said intake and return lines.

9. The method of claim 8 further including the step of:

placing a plug in said intake line near said skimmer to prevent the flow of water into said intake line after the water has been blown out of said intake line.

* * * * *